US009429290B2

(12) United States Patent
Yang

(10) Patent No.: US 9,429,290 B2
(45) Date of Patent: Aug. 30, 2016

(54) HEAD LAMP FOR VEHICLE

(71) Applicant: HYUNDAI MOTOR COMPANY, Seoul (KR)

(72) Inventor: Jeong Gyu Yang, Gyeonggi-Do (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 162 days.

(21) Appl. No.: 14/527,482

(22) Filed: Oct. 29, 2014

(65) Prior Publication Data

US 2015/0117045 A1 Apr. 30, 2015

(30) Foreign Application Priority Data

Oct. 29, 2013 (KR) ..... 10-2013-0129331

(51) Int. Cl.
*F21S 8/10* (2006.01)

(52) U.S. Cl.
CPC ..... *F21S 48/145* (2013.01); *F21S 48/1216* (2013.01); *F21S 48/1258* (2013.01); *F21S 48/1347* (2013.01); *F21S 48/1388* (2013.01)

(58) Field of Classification Search
CPC ..... F21S 48/145; F21S 48/1216; F21S 48/1258; F21S 48/1347; F21S 48/1388
See application file for complete search history.

(56) References Cited

U.S. PATENT DOCUMENTS 7,186,009 B2 * 3/2007 Yamamura ..... F21S 48/1145 362/297
2009/0296419 A1 * 12/2009 Tatsumi ..... B29C 33/44 362/516
2013/0107560 A1 5/2013 Kim et al.

FOREIGN PATENT DOCUMENTS

JP 2008-192313 A 8/2008
KR 10-2011-0074345 A 6/2011

* cited by examiner

*Primary Examiner* — Stephen F Husar
(74) *Attorney, Agent, or Firm* — McDermott Will & Emery LLP

(57) ABSTRACT

A head lamp for a vehicle includes a light source configured to emit a light and a reflective mirror configured to reflect the light. A reflective mirror extended portion extends toward a front of the head lamp from the reflective mirror. An upper shield protrudes radially toward an inner side of the head lamp and shields the light. A lower shield extends toward the front of the head lamp, such that a part of the light transmitted from the light source is indirectly transmitted to the front of the head lamp. A light developing hole is formed between the upper and lower shields to allow another part of the transmitted and reflected light to pass therethrough. A lens mounted to one end of the reflective mirror extended portion allows the light passing through the light developing hole to penetrate the lens and emit the penetrated light toward a front view of the vehicle.

14 Claims, 1 Drawing Sheet

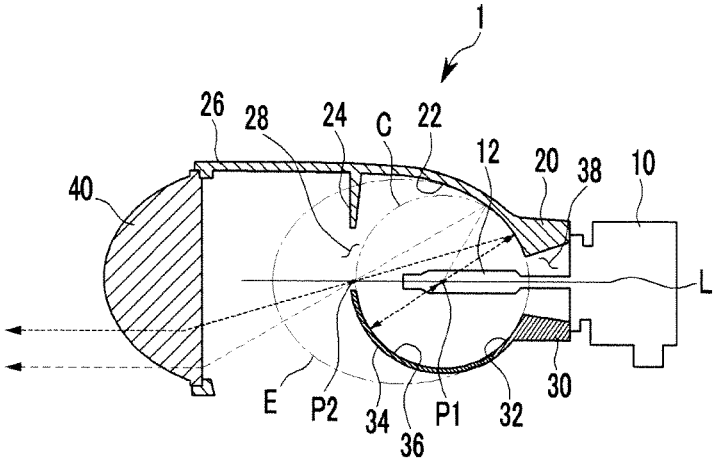
1
26
28
24
C
22
12
20
38
10
40
L
E
P2
34
36
P1
32
30

HEAD LAMP FOR VEHICLE

CROSS-REFERENCE TO RELATED APPLICATION

This application claims the benefit of priority to Korean Patent Application No. 10-2013-0129331 filed in the Korean Intellectual Property Office on Oct. 29, 2013, the entire contents of which are incorporated herein by reference.

TECHNICAL FIELD

The present disclosure relates to a head lamp for a vehicle. More particularly, the present disclosure relates to a head lamp for a vehicle of which luminous efficiency is improved.

BACKGROUND

Generally, a head lamp of a vehicle, also called a head light, lights a front view for safe driving of the vehicle at night or in a dark area.

The head lamp produces a light beam which can be shifted in up/down directions to not dazzle a driver of an oncoming vehicle from an opposite direction. According to safety standards, the high beam is required to identify an obstacle existing at 100 m ahead of the vehicle, and a low beam is required to identify an obstacle at 40 m ahead of the vehicle.

In order to implement such light beam, a shield is disposed between a light source and a lens. The shield shields a portion of a light incident on the lens from the light source or a reflective mirror. According to a shape and movement of the shield, the high beam or the low beam can be selectively implemented.

Because the light shielded by the shield is not used to illuminate, the efficiency of head lamp is limited. In addition, if luminance efficiency of the light passing through the shield is low, the head lamp efficiency may deteriorate in comparison to that of the light source. Thereby further the head lamp efficiency. Particularly, when the low beam is used, the amount of the effective light emitted from the head lamp may be deteriorated as the amount of the light shielded by the shield is increased.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide a head lamp for a vehicle having advantages of improving luminous efficiency.

In addition, the present disclosure has been made in an effort to provide a head lamp for a vehicle having further advantages of improving the performance of the low beam by a simple configuration without increasing the production cost.

A head lamp for a vehicle according to an exemplary embodiment of the present inventive concept may include a light source configured to emit a light. A reflective mirror surrounds the light source configured to reflect the light. A reflective mirror extended portion extends toward a front of the head lamp from an upper part of the reflective mirror. An upper shield protrudes from the reflective mirror extended portion toward an inner side of the head lamp along a radial direction and shields the light such that a part of the light transmitted from the light source toward the front of the head lamp is indirectly transmitted toward the front of the head lamp. A lower shield extends toward the front of the head lamp from a lower part of the reflective mirror and shields light such that the part of the light transmitted from the light source toward the front of the head lamp is indirectly transmitted toward the front of the head lamp. A light developing hole is formed between the upper shield and the lower shield and allows another part of the light transmitted from the light source toward the front of the head lamp and the light reflected by the reflective mirror to pass therethrough toward the front of the head lamp. A lens mounted to one end of the reflective mirror extended portion, allows the light passing through the light developing hole to penetrate the lens, and emits the penetrated light toward a front view of the vehicle.

A shield reflective surface may be formed at the lower shield and reflects the light transmitted from the light source toward the reflective mirror.

The reflective mirror may reflect the light transmitted from the light source and the light transmitted from the shield reflective surface and allows all the light reflected by the reflective mirror to pass through the light developing hole.

A surface reflecting the light of the reflective mirror may be disposed to correspond with a surface of an ellipsoidal solid in which a center of the light source and one point adjacent the lower shield in the light developing hole are two focal points.

The lower shield may extend from the one end of the reflective mirror such that the shield reflective surface is adjacent the one point in the light developing hole.

The shield reflective surface may be disposed to correspond with a surface of a sphere in which the center of the light source is a center of the sphere.

The light reflected by the shield reflective surface may be reflected by the reflective mirror and passes through the light developing hole.

The reflective mirror may be integrally formed with the lower shield. The surface reflecting the light of the reflective mirror may correspond with a surface of an ellipsoidal solid in which a center of the light source and one point adjacent the lower shield in the light developing hole are two focal points. The shield reflective surface may correspond with a surface of a sphere in which the center of the light source is a center of the sphere.

BRIEF DESCRIPTION OF THE DRAWING

The FIGURE is a schematic diagram of a head lamp for a vehicle according to an exemplary embodiment of the present inventive concept.

DETAILED DESCRIPTION OF THE EMBODIMENTS

An exemplary embodiment of the present disclosure will hereinafter be described in detail with reference to the accompanying drawing.

The figure is a schematic diagram of a head lamp for a vehicle according to an exemplary embodiment of the present inventive concept.

As shown in the figure, a head lamp 1 for a vehicle according to an exemplary embodiment of the present disclosure includes a light source 12, an upper reflective mirror 20, an upper shield 24, a lower reflective mirror 30, a lower shield 34, a reflective mirror extended portion 26, and a lens 40.

The light source 12 is connected with and receives electric power from a power supply 10, and emits a light by transferring electrical energy to light energy.

The upper reflective mirror 20 surrounds the light source 12 and extends toward a front side of the head lamp 1. In addition, the upper reflective mirror 30 forms an upper reflective surface 22. Further, the upper reflective surface 22 reflects the light transmitted from the light source 12. The upper shield 24 is formed at one end of the extended upper reflective mirror 20.

The lower reflective mirror 30 surrounds the light source 12 and extends toward the front side of the head lamp 1. In addition, the lower reflective mirror 30 forms a lower reflective surface 32. Further, the lower reflective surface 32 reflects the light transmitted from the light source 12. The lower shield 34 is formed at one end of the extended lower reflective mirror 30.

The upper reflective mirror 20, the lower reflective mirror 30, the upper shield 24, and the lower shield 34 are integrally or respectively formed and then assembled as one body. The upper reflective mirror 20 and the lower reflective mirror 30 together have a hollow cylindrical shape. One surface of the hollow cylindrical shape has an opening toward the front side of the head lamp 1. Herein, the opening of the hollow cylindrical shape of the whole shape of the upper reflective mirror 20 and the lower reflective mirror 30 will be called a "light developing hole 28." That is, the light emitted through the light developing hole 28 from the light source 12 and the light reflected by the upper reflective mirror 20 or the lower reflective mirror 30 are reflected toward the front of the head lamp 1. Further, the light source 12 is inserted through another opening of the hollow cylindrical shape of the whole shape of the upper reflective mirror 20 and the lower reflective mirror 30. Herein, the other opening of the hollow cylindrical shape will be called a "light source insertion hole 38." The light source insertion hole 38 is closed by the power supply 10.

The upper shield 24 protrudes from the one end of the upper reflective mirror 20 toward an inner side of the head lamp 1 along a radial direction. In addition, the lower shield 34 extends from the one end of the lower reflective mirror 30 toward the inner side of the head lamp 1 to form a gradual curved shape along a radial direction. Further, the upper shield 24 and the lower shield 34 shield a part of the light reflected toward the front of the head lamp 1 from the light source 12, the light reflected toward the front of the head lamp 1 by the upper reflective surface 22 of the upper reflective mirror 20, and the light reflected toward the front of the head lamp 1 by the lower reflective surface 32 of the lower reflective mirror 30.

The lower shield 34 forms a shield reflective surface 36 thereon for reflecting the light transmitted from the light source 12 toward the upper reflective surface 22 of the upper reflective mirror 20.

The reflective mirror extended portion 26 extends from the one end of the upper reflective mirror 20 toward the front of the head lamp 1. In addition, the reflective mirror extended portion 26 may have a ring shape which is concentrically disposed with the hollow cylindrical shape of the upper reflective mirror 20 and the lower reflective mirror 30.

The lens 40 fits in and mounted to the ring shape of the reflective mirror extended portion 26. In addition, the lens 40 is disposed to collect the light emitted from the light source 12 and emit the collected light emitted from the light source 12 toward the front of the head lamp 1. That is, the light passing through the light developing hole 28 penetrates the lens 40 so as to be emitted toward the front of the head lamp 1. In order to reduce a spherical aberration, the lens 40 may be an aspherical lens having a small number of surfaces. The aspherical lens is well-known to a person of an ordinary skill in the art such that a detailed description thereof will be omitted.

The figure shows an adjoint line L which passes through the center of the light source 12 and the center P1 of the circle C of the hollow cylindrical shape formed by the upper reflective mirror 20 and the lower reflective mirror 30. In addition, the center of the circle C P1 is in the light source 12. The figure further shows an ellipse E having a focal point at a center P1 of the circle C along the center line of the light source 12 and a second focal point at a cross point P2 where the adjoint line L intersects the light developing hole 28.

In the ellipse E, the center P1 of the circle C will be called the "first focal point P1," and the cross point P2 will be called the "second focal point P2".

When the circle C extends 3-dimensionally so as to form a sphere C, the shield reflective surface 36 is formed and corresponds with a surface of the sphere C. In addition, when the ellipse E extends 3-dimensionally so as to form an ellipsoidal solid E. the upper reflective surface 22 and the lower reflective surface 32 are formed and correspond with a surface of the ellipsoidal solid E. The lower shield 34 which forms the shield reflective surface 36 extends from the one end of the lower reflective mirror 30, such that, the shield reflective surface 36 is adjacent the second focal point P2. However, the shapes of the upper reflective surface 22, the lower reflective surface 32, and the shield reflective surface 36 are not limited thereto, and the shapes can be variously designed by a person of an ordinary skill in the art, such that, all light reflected by the upper reflective surface 22 and the lower reflective surface 32 are passed through the light developing hole 28, and all light reflected by the shield reflective surface 36 are transmitted to the upper reflective surface 22.

Hereinafter, development of light according to the shapes and the disposition of the upper reflective surface 22, the lower reflective surface 32, and the shield reflective surface 36 will be described in detail.

If a part of light emitted from the point P1 in the light source 12 toward the front of the head lamp 1 reaches to the shield reflective surface 36, the light reaching to the shield reflective surface 36 is reflected by the shield reflective surface 36. In addition, if the light reflected by the shield reflective surface 36 reaches to the upper reflective surface 22 via the first focal point P1 again, the light reaching to the upper reflective surface 22 is reflected by the upper reflective surface 22. Further, the light reflected by the upper reflective surface 22 is developed via the second focal point P2, and simultaneously, passes through the light developing hole 28.

Another part of the light emitted from the point P1 in the light source 12 toward the front of the head lamp 1 directly passes through the light developing hole 28. The other part of the light emitted from the point P1 of the light source 12 toward the front of the head lamp 1 is shielded by the upper shield 24.

The light directly transmitted from the point P1 of the light source 12 to the upper reflective surface 22 and the light directly transmitted from the point P1 to the lower reflective surface 32 are respectively reflected by the upper reflective surface 22 and the lower reflective surface 32, and the light reflected by the upper reflective surface 22 and the lower reflective surface 32 is developed via the second focal point P2, and simultaneously, passes through the light developing hole 28.

The light passing through the light developing hole 28 penetrates the lens 40 so as to be developed toward the front of the head lamp 1 and emitted to a front view of a vehicle. Particularly, as the light transmitted to the lower shield 34 is sequentially reflected by the shield reflective surface 36 and the upper reflective surface 22 and used as the low beam, efficiency of the light emitted from the light source 12 used for the low beam increases.

According to the exemplary embodiment of the present disclosure, efficiency of useful light emitted from the light source 12 can be increased by using light shielded by the shield 34. In addition, performance of the low beam may be improved while minimizing production cost as the shield reflective surface 36 is formed at the lower shield 34. Further, driving safety can be ensured since luminous efficiency of the low beam is improved. While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A head lamp for a vehicle comprising:

a light source configured to emit a light;

a reflective mirror surrounding the light source configured to reflect the light;

a reflective mirror extended portion extending toward a front of the head lamp from an upper part of the reflective mirror;

an upper shield protruding from the reflective mirror extended portion to toward an inner side of the head lamp along a radial direction, the upper shield shielding the light such that a part of the light transmitted from the light source toward the front of the head lamp is indirectly transmitted toward the front of the head lamp;

a lower shield extending toward the front of the head lamp from a lower part of the reflective mirror, the lower shield shielding the light such that the part of the light transmitted from the light source toward the front of the head lamp is indirectly transmitted toward the front of the head lamp;

a light developing hole formed between the upper shield and the lower shield, the light developing hole allowing another part of the light transmitted from the light source and the light reflected by the reflective mirror to pass therethrough toward the front of the head lamp; and a lens mounted to one end of the reflective mirror extended portion, the lens allowing the light passing through the light developing hole to penetrate the lens and emit the penetrated light toward a front view of the vehicle.

2. The head lamp of claim 1, further comprising:

a shield reflective surface formed at an inner side of the lower shield, the shield reflective surface reflecting the light transmitted from the light source toward the reflective mirror.

3. The head lamp of claim 2, wherein the reflective mirror reflects the light transmitted from the light source and the light transmitted from the shield reflective surface and allows all the light reflected by the reflective mirror to pass through the light developing hole.

4. The head lamp of claim 1, further comprising:

a reflective surface configured to reflect the light from the reflective mirror disposed to correspond with a surface of an ellipsoidal solid in which a center of the light source and one point adjacent the lower shield in the light developing hole are two focal points.

5. The head lamp of claim 4, wherein the lower shield extends from the one end of the reflective mirror such that the shield reflective surface is adjacent the one point in the light developing hole.

6. The head lamp of claim 2, wherein the shield reflective surface is disposed to correspond with a surface of a sphere in which the center of the light source is a center of the sphere.

7. The head lamp of claim 2, wherein the light reflected by the shield reflective surface is reflected by the reflective mirror and passes through the light developing hole.

8. The head lamp of claim 2, wherein the reflective mirror is integrally formed with the lower shield, the surface reflecting the light of the reflective mirror corresponds with a surface of an ellipsoidal solid in which a center of the light source and one point adjacent the lower shield in the light developing hole are two focal points, and the shield reflective surface corresponds with a surface of a sphere in which the center of the light source is a center of the sphere.

9. The head lamp of claim 7, wherein the light passing through the light developing hole is used as a low beam light.

10. The head lamp of claim 1, wherein the reflective mirror comprises a plurality of mirrors including an upper reflective mirror disposed at an upper side of the head lamp and a lower reflective mirror disposed at a lower side of the head lamp.

11. The head lamp of claim 3, wherein the reflective surface comprises a plurality of surfaces including an upper reflective surface disposed at an upper side of the head lamp and a lower reflective surface disposed at a lower side of the head lamp.

12. The head lamp of claim 1, wherein the upper reflective mirror and the lower reflective mirror together form a hollow cylindrical shape.

13. The head lamp of claim 12, wherein the light source is connected with and receives electric power from, and the light source emits the light by transferring electrical energy to light energy.

14. The head lamp of claim 13, further comprising:

a light source insertion hole formed between the upper reflective mirror and the lower reflective mirror, wherein the light source insertion hole is closed by the power supply.

* * * * *